US012089682B1

(12) United States Patent
Ashworth

(10) Patent No.: US 12,089,682 B1
(45) Date of Patent: Sep. 17, 2024

(54) BATH SHOWER ACCESSORY

(71) Applicant: Zachary Ashworth, Spring, TX (US)

(72) Inventor: Zachary Ashworth, Spring, TX (US)

( * ) Notice: Subject to any disclaimer, the term of this patent is extended or adjusted under 35 U.S.C. 154(b) by 0 days.

(21) Appl. No.: 18/415,314

(22) Filed: Jan. 17, 2024

(51) Int. Cl.

| | |
|---|---|
| ***A42B 3/04*** | (2006.01) |
| ***A42B 3/12*** | (2006.01) |
| ***A42B 3/32*** | (2006.01) |
| ***A47K 3/12*** | (2006.01) |

(52) U.S. Cl.
CPC ..... *A42B 3/0406* (2013.01); *A42B 3/12* (2013.01); *A42B 3/326* (2013.01); *A47K 3/125* (2013.01)

(58) Field of Classification Search
CPC .. A47K 3/125; A42B 3/12; A42B 3/20; A42B 3/22; A42B 3/222; A42B 3/225; A42B 3/30
USPC ..... 4/519, 520, 523, 573.1, 575.1
See application file for complete search history.

(56) References Cited

U.S. PATENT DOCUMENTS

| | | | | |
|---|---|---|---|---|
| 3,854,148 | A * | 12/1974 | La Rose | A61H 35/008 4/519 |
| 4,130,120 | A | 12/1978 | Kohler | |
| 4,389,740 | A * | 6/1983 | Henry | A47K 3/125 4/575.1 |
| 4,553,534 | A * | 11/1985 | Stiegler | A42B 3/22 600/28 |
| 5,329,650 | A | 7/1994 | Zaccai | |
| 5,891,186 | A | 4/1999 | Daffer | |
| 7,810,179 | B2 | 10/2010 | Fujikawa | |
| 10,098,811 | B2 | 10/2018 | Jaguan | |
| 2004/0260364 | A1 | 12/2004 | Daffer | |
| 2009/0264073 | A1* | 10/2009 | Kushnirov | A42B 3/30 455/575.2 |
| 2012/0222185 | A1 | 9/2012 | Erikson | |
| 2013/0152299 | A1 | 6/2013 | Mizuno | |
| 2016/0271012 | A1 | 9/2016 | Xu | |
| 2021/0361013 | A1* | 11/2021 | Pickett | A42B 3/225 |
| 2022/0142287 | A1* | 5/2022 | Newton | A42B 3/30 |

FOREIGN PATENT DOCUMENTS

| | | | |
|---|---|---|---|
| DE | 202007001669 | U1 | 4/2007 |
| DE | 102013209564 | | 11/2013 |
| FR | 2556974 | A1 * | 6/1985 |
| FR | 3023680 | A1 | 1/2016 |
| KR | 200341476 | Y1 | 2/2004 |
| WO | WO2003053324 | | 7/2003 |
| WO | WO2014108581 | A1 | 7/2014 |

OTHER PUBLICATIONS

Hairbrella Pro Rain Hat with Face Shield for Women, 100% Waterproof. Twelve pages downloaded from the internet Aug. 12, 2023. https://www.hairbrella.com/products/hairbrella-pro-satin-lined-rain-hat?variant=32199540146236&currency=USD&utm_medium=product_sync&utm_source=goog.

* cited by examiner

*Primary Examiner* — Tuan N Nguyen
(74) *Attorney, Agent, or Firm* — Examiners Edge; Gary ONeill

(57) ABSTRACT

A shower helmet device with a moveable face guard includes a removably attached curvilineal deflector, a cranium cradle attachable to the moveable face guard and has a cranium cushion arranged within a cranium cradle interior. In various embodiments a cervical spine support and a cradle positioner provide additional stability for a user. The shower helmet device provides a relaxing, refreshing, and visually stimulating user experience while showering.

20 Claims, 2 Drawing Sheets

BATH SHOWER ACCESSORY

BACKGROUND

This application relates to a bath shower accessory, such as a shower helmet.

Personal hygiene products and methods are known which are intended to facilitate personal cleanliness and comfort. From ancient civilizations, numerous bathing structures and bath accessories have been developed and are known to aid and expedite mundane and special use activities related to washing and purification of humans and animals alike. Among the most well known of these are bathtubs and wash basins which have been employed in many societies around the world for individual cleansing activities and related purposes. In more recent times indoor plumbing technologies have advanced sufficiently to provide running water installations within residential dwellings such that hot and cold-water flow availability from faucets and shower heads are now commonplace in many areas of the world.

It is known that haircare and facial care present some unique challenges with respect to the safety and effectiveness of the requisite specialized cleansing requirements. Consequently, an array of devices and systems have been developed to protect the face and eyes from injury during hair washing or to protect the hair during showering.

Moreover, flowing water may be applied to various portions of the body and has been known to aid not only with cleansing activities, but also to produce calming and relaxing effects on the recipient's mental state and health. Indeed, fluid therapies, including water-based therapies, can provide many health benefits for patients suffering from a variety of conditions, as well as those seeking to maintain a high state of physical, mental, and spiritual well-being. Such fluid therapies are limited however with respect to usability for the more sensitive areas of the body and require special precautions to avoid unintended injuries.

SUMMARY

In general, in a first aspect, the invention features a shower helmet apparatus with a moveable face guard including a removably attached curvilineal deflector, a cranium cradle attachable to the moveable face guard and having a cranium cushion arranged within a cranium cradle interior, a plurality of low-pressure seals arranged along at least one of a plurality of cranium cradle exterior surfaces, a cervical spine support attachable to the cranium cradle and having a cervical spine platform mounted upon cervical spine support walls. A cradle positioner is configured to simultaneously attach to the cranium cradle and an exterior wall surface, such that the moveable face guard, cranium cradle, cervical spine support and cradle positioner are arranged to substantially shield a user's face from water entry of a water flow which is directed towards the eyes of a user wearing the shower helmet while the user is showering in a supine body position.

In general, in a second aspect, the invention features a therapeutic shower helmet having a moveable face guard including a removably attached curvilineal deflector, a cranium cradle attachable to the moveable face guard and having a cranium cushion arranged within a cranium cradle interior. A cranium chamber is embedded within the cranium cradle interior, the cranium chamber further comprising a transducer frame, a transducer, and a waterproof grille each axially concentric and arranged within the cranium chamber. A plurality of low-pressure seals are arranged along at least one of a plurality of cranium cradle exterior surfaces and a cervical spine support is attachable to the cranium cradle and has a cervical spine platform mounted upon cervical spine support walls. The moveable face guard, cranium cradle, and cervical spine support are arranged to substantially shield a user's face from water entry of a water flow which is directed towards the eyes of a user wearing the therapeutic shower helmet while the user is viewing the water flow through the moveable face guard from a supine relaxed body position.

Embodiments of the invention may include one or more of the following features. These features may be used singly, or in combination with each other. The shower helmet wherein the moveable face guard further comprises a guard housing and a circumferential guard lip, the removably attached curvilineal deflector configured for attachment to the circumferential guard lip.

The shower helmet wherein the removably attached curvilineal deflector further comprises at least one curvilineal deflector concavity.

The shower helmet wherein the guard housing includes one or more articulation arms attached at a distal end to a portion of the moveable face guard, the one or more articulation arms operable to allow angular rotation of the moveable face guard with respect to the user's face, the rotation around an axis intersecting a proximal end of the one or more articulation arms.

The shower helmet wherein the cranium cradle interior of the cranium cradle is dimensioned and shaped to conformably receive a rear portion of a human cranium, the cranium cushion comprising a compressible surface.

The shower helmet wherein the cranium cradle interior of the cranium cradle comprises a waterproof foam.

The shower helmet wherein the cranium cradle interior of the cranium cradle comprises a rigid plastic shell portion with closed cell waterproof foam inserts.

The shower helmet wherein the plurality of low-pressure seals comprise vacuum suction seals removably attachable to shower interior surfaces.

The shower helmet wherein the proximal end of the one or more articulation arms is configured for insertion into a corresponding socket formed in an upper rear portion of the cranium cradle.

The therapeutic shower helmet wherein the moveable face guard further comprises a guard housing and a circumferential guard lip, the removably attached curvilineal deflector configured for attachment to the circumferential guard lip.

The therapeutic shower helmet wherein the removably attached curvilineal deflector further comprises at least one curvilineal deflector concavity.

The therapeutic shower helmet wherein the guard housing includes one or more articulation arms attached at a distal end to a portion of the moveable face guard, the one or more articulation arms operable to allow angular rotation of the moveable face guard with respect to the user's face, the rotation around an axis intersecting a proximal end of the one or more articulation arms.

The therapeutic shower helmet wherein the cranium cradle interior of the cranium cradle is dimensioned and shaped to conformably receive a rear portion of a human cranium, the cranium cushion comprising a compressible surface.

The therapeutic shower helmet wherein the transducer comprises a self-contained power source and at least one of a waterproof speaker, a waterproof microphone, and a waterproof telephone.

The therapeutic shower helmet wherein the transducer comprises one or more wireless circuits.

The therapeutic shower helmet wherein the removably attached curvilineal deflector is substantially transparent.

The therapeutic shower helmet wherein the removably attached curvilineal deflector is substantially translucent.

The therapeutic shower helmet wherein the removably attached curvilineal deflector is substantially of at least one color.

The therapeutic shower helmet wherein the removably attached curvilineal deflector is substantially opaque.

The above advantages and features are of representative embodiments only and are presented only to assist in understanding the invention. It should be understood that they are not to be considered limitations on the invention as defined by the claims. Additional features and advantages of embodiments of the invention will become apparent in the following description, from the drawings, and from the claims.

DESCRIPTION

Figure 1:
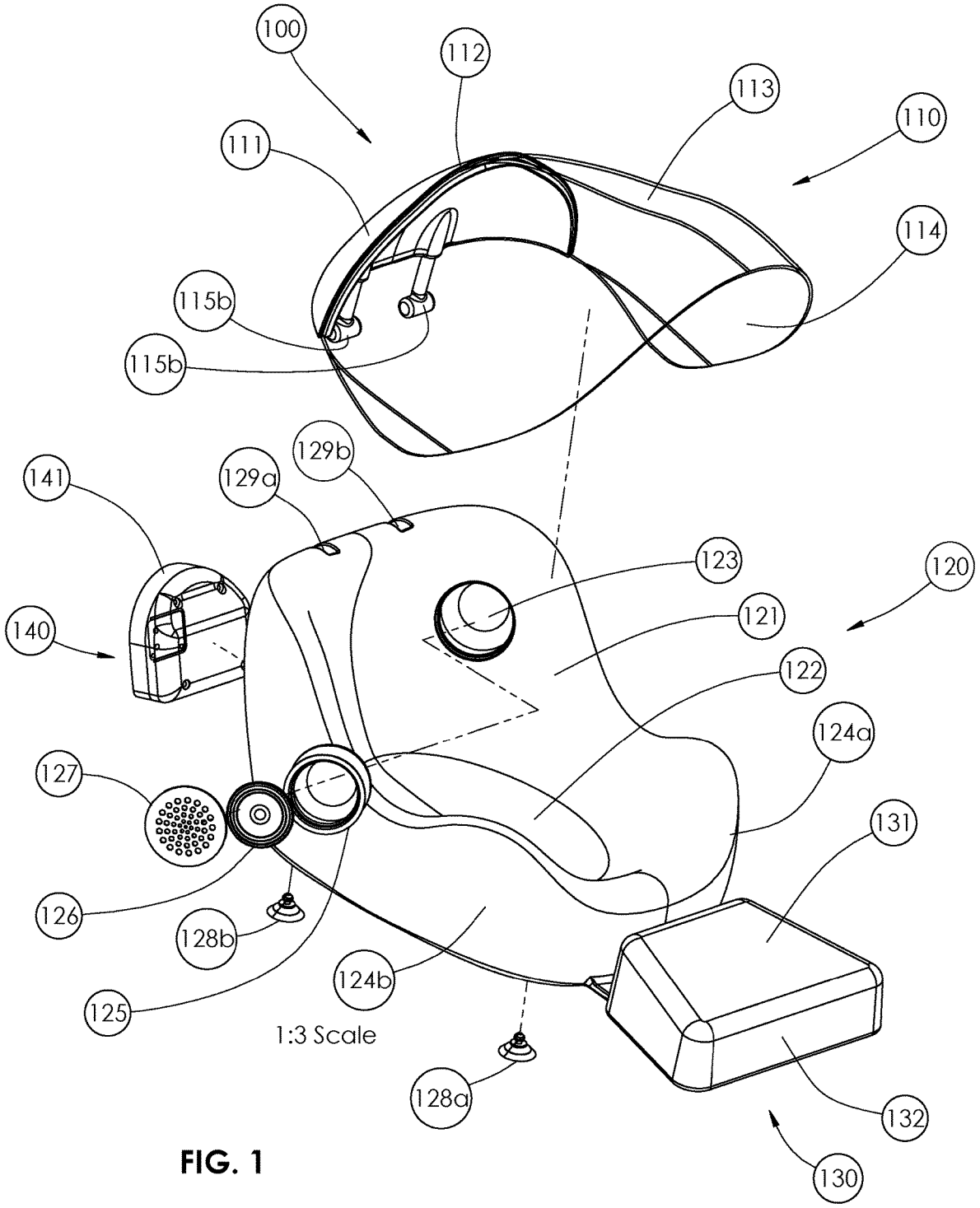
FIG. 1 is an exploded perspective view of embodiments of the present invention.
Figure 2:
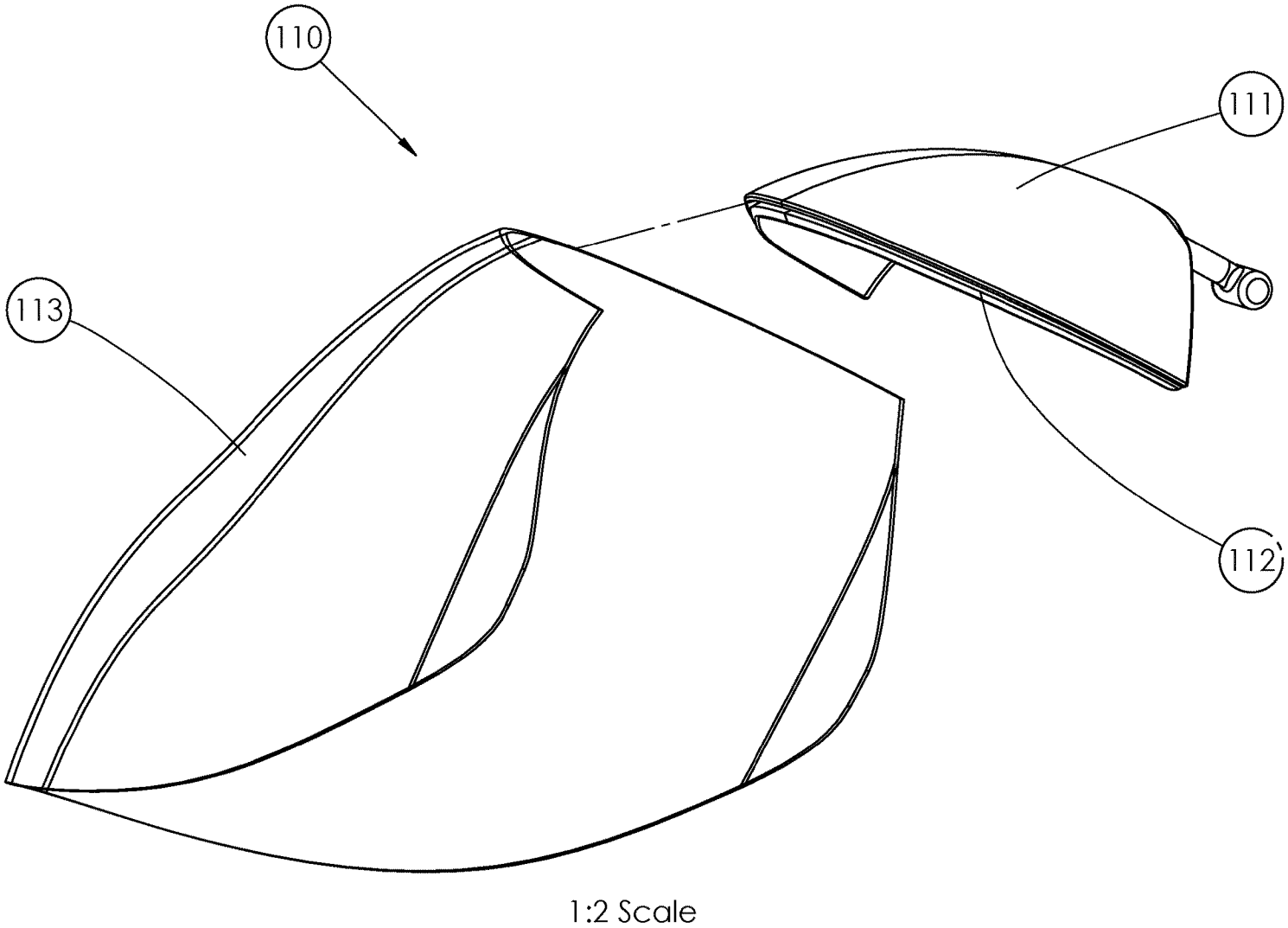
FIG. 2 is a perspective view of embodiments of the face guard of the present invention.

Referring now to the drawings, wherein like reference numerals designate corresponding structure throughout the views.

Referring to FIG. 1, an exploded view of a shower helmet 100 of the present invention is shown. The shower helmet 100 may be worn by a user to provide a comfortable, relaxing, and refreshing sensory experience for a user during a showering event. The present invention allows the user to view the flow of water falling downwards from a shower head and to the face of the user while protecting the users' eyes, which may be in an open position as the water flow is deflected away from the eyes, while the user is lying in a supine position on a shower stall compartment floor. The shower helmet 100 includes the following major components: a face guard 110, a cranium cradle 120, a cervical spine support 130, and a cradle positioner 140.

The face guard 110 is pivotable about a rotation angle such that the face guard 110 may be manually positioned by a user from a first closed position which surrounds the user's eyes and face to a second open position in which the face guard 110 is pivoted away from the users face towards an upright position at an obtuse angle with respect to the users face. The face guard 110 includes a curvilineal deflector 113 which is removably attached to a guard housing 111 along a circumferential guard lip 112. The guard housing 111 includes one or more articulation arms 115*a*, 115*b* attached at a distal end to a portion of said moveable face guard 110, to facilitate angular rotation of the moveable face guard 110. The curvilineal deflector 113 may include one or more curvilineal deflector concavities 114, the one or more curvilineal deflector concavities 114 allow the curvilineal deflector 113 to semi-circularly surround the front, left, and right-side portions of a user's face when the face guard 110 is rotated by the user into the first closed position. Thus, in the first closed position, a user's eyes and face are fully shielded from the flow of water falling downwards from a shower head towards the user's face. The user may therefore safely open the eyes and view the incoming water flow towards the user's face to experience a relaxing, refreshing, and visually stimulating environment without injury. The user may further enhance the sensory stimulation, stress reduction, and relaxation effects by selecting and/or substitution of a variety of different curvilineal deflectors 113 including curvilineal deflectors 113 which are substantially transparent, substantially translucent, substantially of at least one color, or substantially opaque. The sensory stimulation effects, and thus therapeutic enhancements to the user are therefore controllable by the user via the selection of a combination of the removably attached curvilineal deflectors 113 light transmissive and reflective characteristics and the adjustable volume of shower water flow which creates varying attractive dispersive water patterns upon impact against the installed curvilineal deflector 113.

A cranium cradle 120 which is dimensioned, shaped, and fitted to comfortably conform to a rear portion of a user's cranium, receives a user's cranium during a shower use when the user's body is supine within the shower stall compartment. The cranium cradle 120 is attachable to the moveable face guard 110 and also has a cranium cushion 122 arranged within a cranium cradle interior 121. A proximal end of the one or more articulation arms 115*a*, 115*b* is configured for insertion into corresponding sockets 129*a*, 129*b* formed in an upper rear portion of said cranium cradle 120. The cranium cradle 120 also includes a cranium cushion 122 which is arranged within a cranium cradle interior 121 area. The cranium cushion 122 may include a compressible surface. The cranium cradle interior 121 may include a waterproof foam. The cranium cradle interior 121 may include a rigid plastic shell portion with closed cell waterproof foam inserts. A plurality of low-pressure seals 128*a*, 128*b* through 128*n* are arranged along at least one of a plurality of cranium cradle exterior surfaces 124*a*, 124*b*, etc. The low-pressure seals 128*a*, 128*b* through 128*n* may be vacuum suction seals, for example suction cup seal devices, which may be removably attachable to interior surfaces of a shower stall compartment.

In some embodiments, a cranium chamber 123 may be embedded within the cranium cradle interior 121. The cranium chamber 123 may provide an enclosed storage area for housing a transducer frame 125 for securing a transducer 126 within the cranium chamber 123. A waterproof grille 127 may seal the transducer frame 125 and transducer 126 assembly within the cranium chamber 123. When assembled, the transducer frame 125, transducer 126, and waterproof grille 127 are axially concentric within the cranium chamber 123. The transducer 126 may include a self-contained power source such as a battery or an electrochemical cell. The transducer 126 may further include at least one of a waterproof speaker, a waterproof microphone, and a waterproof telephone. Transducer 126 may additionally include one or more wireless circuits for operation via one or more wireless technologies such as Bluetooth®. Transducer 126 may thus provide audio capabilities such as music or other sounds as well as telephone answering and conversational capabilities for convenient and expanded sensory therapeutic experiences for a user during shower helmet 100 operation.

In some embodiments, a cervical spine support 130 may be attached to the cranium cradle 120. The cervical spine support 130 may include a cervical spine platform 131 which may be mounted upon cervical spine support walls 132. The cervical spine support 130 may provide enhanced comfort to a user by adding an elongated platform arranged under the cervical spine of a supine user at a desirable elevation to achieve spinal comfort.

In some embodiments, a cradle positioner 140 may be included. The cradle positioner 140 may be attachable to a rear surface of the cranium cradle 120 and may simultaneously be attached to an exterior wall surface of a shower stall compartment. When attached the cradle positioner 140 provides additional stability for precise positioning of the cranium cradle 120, and thus the supine user, at a desired area within the shower stall compartment.

For clarity of explanation, the above description has focused on a representative sample of all possible embodiments, a sample that teaches the principles of the invention and conveys the best mode contemplated for carrying it out. The invention is not limited to the described embodiments. Well known features may not have been described in detail to avoid unnecessarily obscuring the principles relevant to the claimed invention. Throughout this application and its associated file history, when the term "invention" is used, it refers to the entire collection of ideas and principles described; in contrast, the formal definition of the exclusive protected property right is set forth in the claims, which exclusively control. The description has not attempted to exhaustively enumerate all possible variations. Other undescribed variations or modifications may be possible. Where multiple alternative embodiments are described, in many cases it will be possible to combine elements of different embodiments, or to combine elements of the embodiments described here with other modifications or variations that are not expressly described. A list of items does not imply that any or all of the items are mutually exclusive, nor that any or all of the items are comprehensive of any category, unless expressly specified otherwise. In many cases, one feature or group of features may be used separately from the entire apparatus or methods described. Many of those undescribed alternatives, variations, modifications, and equivalents are within the literal scope of the following claims, and others are equivalent. The claims may be practiced without some or all of the specific details described in the specification. In many cases, method steps described in this specification can be performed in different orders than that presented in this specification, or in parallel rather than sequentially.

A portion of the disclosure of this patent document contains material that is protected by copyright. The copyright owner has no objection to the facsimile reproduction of the patent document or the patent disclosure as it appears in the Patent and Trademark Office file or records, but otherwise reserves all copyright rights whatsoever.

The invention claimed is:

1. A shower helmet comprising:

a moveable face guard including a removably attached curvilineal deflector;

a cranium cradle attachable to said moveable face guard and having a cranium cushion arranged within a cranium cradle interior;

a plurality of low-pressure seals arranged along at least one of a plurality of cranium cradle exterior surfaces;

a cervical spine support attachable to said cranium cradle and having a cervical spine platform mounted upon cervical spine support walls;

a cradle positioner configured to simultaneously attach to said cranium cradle and an exterior wall surface, wherein said moveable face guard, cranium cradle, cervical spine support and cradle positioner are arranged to substantially shield a user's face from water entry of a water flow which is directed towards the eyes of a user wearing said shower helmet while the user is showering in a supine body position.

2. The shower helmet of claim 1, wherein said moveable face guard further comprises a guard housing and a circumferential guard lip, said removably attached curvilineal deflector configured for attachment to the circumferential guard lip.

3. The shower helmet of claim 2, wherein said guard housing includes one or more articulation arms attached at a distal end to a portion of said moveable face guard, said one or more articulation arms operable to allow angular rotation of said moveable face guard with respect to said users face, said rotation around an axis intersecting a proximal end of said one or more articulation arms.

4. The shower helmet of claim 3, wherein said proximal end of said one or more articulation arms is configured for insertion into a corresponding socket formed in an upper rear portion of said cranium cradle.

5. The shower helmet of claim 1, wherein said removably attached curvilineal deflector further comprises at least one curvilineal deflector concavity.

6. The shower helmet of claim 1, wherein said cranium cradle interior of said cranium cradle is dimensioned and shaped to conformably receive a rear portion of a human cranium, said cranium cushion comprising a compressible surface.

7. The shower helmet of claim 6, wherein said cranium cradle interior of said cranium cradle comprises a waterproof foam.

8. The shower helmet of claim 6, wherein said cranium cradle interior of said cranium cradle comprises a rigid plastic shell portion with closed cell waterproof foam inserts.

9. The shower helmet of claim 1, wherein said plurality of low-pressure seals comprise vacuum suction seals removably attachable to shower interior surfaces.

10. A therapeutic shower helmet comprising:

a moveable face guard including a removably attached curvilineal deflector;

a cranium cradle attachable to said moveable face guard and having a cranium cushion arranged within a cranium cradle interior;

a cranium chamber embedded within said cranium cradle interior, said cranium chamber further comprising a transducer frame, a transducer, and a waterproof grille each axially concentric and arranged within said cranium chamber;

a plurality of low-pressure seals arranged along at least one of a plurality of cranium cradle exterior surfaces;

a cervical spine support attachable to said cranium cradle and having a cervical spine platform mounted upon cervical spine support walls;

wherein said moveable face guard, cranium cradle, and cervical spine support are arranged to substantially shield a user's face from water entry of a water flow which is directed towards the eyes of a user wearing said therapeutic shower helmet while the user is viewing said water flow through said moveable face guard from a supine relaxed body position.

11. The therapeutic shower helmet of claim 10, wherein said moveable face guard further comprises a guard housing and a circumferential guard lip, said removably attached curvilineal deflector configured for attachment to the circumferential guard lip.

12. The therapeutic shower helmet of claim 10, wherein said removably attached curvilineal deflector further comprises at least one curvilineal deflector concavity.

13. The therapeutic shower helmet of claim 10, wherein said guard housing includes one or more articulation arms attached at a distal end to a portion of said moveable face guard, said one or more articulation arms operable to allow angular rotation of said moveable face guard with respect to said users face, said rotation around an axis intersecting a proximal end of said one or more articulation arms.

14. The therapeutic shower helmet of claim 10, wherein said cranium cradle interior of said cranium cradle is dimensioned and shaped to conformably receive a rear portion of a human cranium, said cranium cushion comprising a compressible surface.

15. The therapeutic shower helmet of claim 10, wherein said transducer comprises a self-contained power source and at least one of a waterproof speaker, a waterproof microphone, and a waterproof telephone.

16. The therapeutic shower helmet of claim 15, wherein said transducer comprises one or more wireless circuits.

17. The therapeutic shower helmet of claim 10, wherein said removably attached curvilineal deflector is substantially transparent.

18. The therapeutic shower helmet of claim 10, wherein said removably attached curvilineal deflector is substantially translucent.

19. The therapeutic shower helmet of claim 10, wherein said removably attached curvilineal deflector is substantially of at least one color.

20. The therapeutic shower helmet of claim 10, wherein said removably attached curvilineal deflector is substantially opaque.

* * * * *